US010094004B2

(12) United States Patent
Hardy et al.

(10) Patent No.: US 10,094,004 B2
(45) Date of Patent: Oct. 9, 2018

(54) ALLOY

(71) Applicant: ROLLS-ROYCE plc, London (GB)

(72) Inventors: Mark Christopher Hardy, Derby (GB); David Dye, London (GB); Howard James Stone, Cambridge (GB); Huiyu Yan, Hong Kong (HK)

(73) Assignee: ROLLS-ROYCE plc, London (GB)

( * ) Notice: Subject to any disclaimer, the term of this patent is extended or adjusted under 35 U.S.C. 154(b) by 335 days.

(21) Appl. No.: 14/961,170

(22) Filed: Dec. 7, 2015

(65) Prior Publication Data

US 2016/0168662 A1 Jun. 16, 2016

(30) Foreign Application Priority Data

Dec. 10, 2014 (GB) ..... 1421949.7

(51) Int. Cl.

| | |
|---|---|
| ***C22C 19/07*** | (2006.01) |
| ***C22C 30/00*** | (2006.01) |
| ***C22C 1/04*** | (2006.01) |

(52) U.S. Cl.

CPC ..... *C22C 19/07* (2013.01); *C22C 1/0433* (2013.01); *C22C 30/00* (2013.01)

(58) Field of Classification Search

CPC ..... C22C 19/07; C22C 30/00; C22C 1/0433

See application file for complete search history.

(56) References Cited

U.S. PATENT DOCUMENTS

| | | | |
|---|---|---|---|
| 4,569,824 | A | 2/1986 | Duhl et al. |
| 2011/0268989 | A1 | 11/2011 | Suzuki et al. |
| 2012/0312426 | A1 | 12/2012 | Suzuki et al. |
| 2012/0312434 | A1 | 12/2012 | Suzuki et al. |

FOREIGN PATENT DOCUMENTS

| | | | |
|---|---|---|---|
| EP | 0 585 768 | A1 | 3/1994 |
| EP | 2 383 356 | A1 | 11/2011 |
| EP | 2 532 761 | A1 | 12/2012 |
| EP | 2821519 | A1 | 1/2015 |
| JP | 2009-228024 | A | 10/2009 |

OTHER PUBLICATIONS

Mar. 23, 2016 Extended Search Report issued in European Patent 15 19 8180.

Sep. 18, 2015 Search Report issued in British Patent Application No. GB1421949.7.

*Primary Examiner* — Jessee R Roe

(74) *Attorney, Agent, or Firm* — Oliff PLC

(57) ABSTRACT

A cobalt-nickel alloy composition comprising by weight (wt %): about 31 to 42 percent cobalt (Co); about 26 to 31 percent nickel (Ni); about 10 to 16 percent chromium (Cr); about 4 to 6 percent aluminum (Al); about 6 to 15 percent tungsten (W); the Co and Ni being present in an atomic ratio of about 1.3:1.

20 Claims, No Drawings

ALLOY

TECHNICAL FIELD OF INVENTION

The invention relates to alloys suitable for high temperature applications and particularly cobalt/nickel alloys that may be used to manufacture components in a gas turbine engine.

BACKGROUND OF INVENTION

Certain portions of a gas turbine engine are expected to operate for extended periods of time at temperatures above 700° C. and to peak temperatures of 800° C. or more. The components operating within these portions, such as e.g. disc rotors, aerofoils or casings, are often under high stress caused by rotational, pressure or other forces.

There is a requirement to provide improved alloys that extend temperature capability or the number of operating cycles and operation time for components within difficult conditions in order to provide an affordable service life.

It is an object of the present invention to seek to provide an improved alloy.

STATEMENTS OF INVENTION

According to a first aspect of the invention there is provided a cobalt-nickel alloy composition comprising by weight (wt): about 31 to 42 percent cobalt (Co); 10 to 16 percent chromium (Cr); about 4 to 6 percent aluminium (Al); about 6 to 15 percent tungsten (W); and the balance nickel (Ni) plus incidental impurities the Ni being present in an amount of about 26 to 30 percent nickel and wherein the Co and Ni are present in an atomic ratio between 1.2:1 and 1.4:1.

Preferably the alloy further comprises at least one of niobium (Nb) or tantalum (Ta) wherein the combined total of niobium, tantalum and tungsten is 10 to 15 percent.

Preferably the Co and Ni are present in the ratio of 1.3:1.

The alloy may comprise about 35.2 to 40.2 wt % Co.

The alloy may comprise about 27.0 to 30.8 wt % Ni.

The alloy may comprise about 7.0 to 9.3 wt % W.

The alloy may comprise about 13.0 to 14.3 wt % Cr.

The alloy may comprise iron (Fe) in an amount up to 8 wt % of the alloy. The iron may be present in an amount around 7.5 wt %

The alloy may comprise manganese (Mn) in an amount up to 0.6 wt % of the alloy

The alloy may comprise molybdenum (Mo) in an amount up to 4 wt % of the alloy. The molybdenum may be present in an amount around 3.3. wt %.

The alloy may comprise 4.0 to 5.6 wt % Aluminium (Al).

The alloy may comprise tantalum (Ta) in an amount up to 5.0 wt %. The alloy may comprise 2.3 to 3.1 wt % tantalum (Ta).

The alloy may comprise Nb in an amount up to 2.5 wt % of the alloy. The alloy may contain 1.5 to 1.6 wt % niobium.

The alloy may comprise Ti in an amount up to 2.0 wt % of the alloy.

The alloy may comprise silicon (Si) in an amount up to 1.0 wt % of the alloy. The alloy may contain 0.5 to 0.6 wt % silicon.

The alloy may comprise carbon (C) in an amount up to 0.05 wt % of the alloy. Carbon may be present in amount from 0.01 to 0.03 wt % of the alloy.

The alloy may comprise boron (B) in an amount up to 0.05 wt % of the alloy. Boron may be present in amount from 0.02 to 0.05 wt % of the alloy.

The alloy may comprise zirconium (Zr) in an amount 0.1 wt % of the alloy. Zirconium may be present in amount from 0.05 to 0.06 wt % of the alloy.

The alloy may comprise hafnium (Hf) in an amount up to 0.1 wt % of the alloy.

The alloy may be formed from a powder of the elemental constituents, produced by argon gas atomisation or alternatively through ingot metallurgy.

DETAILED DESCRIPTION OF INVENTION

Metallic alloys are compositions comprising a mixture of metallic elements. Subjecting some Ni containing alloys to specific heat treatments or other processing steps permits precipitation strengthening by the formation of gamma prime (γ') precipitates. Cobalt-nickel alloys containing Al and W can be precipitation strengthened by the ordered $L1_2Co_3(Al, W)$ γ' precipitates as well as the $Ni_3Al$γ' precipitates that are found in conventional Ni base superalloys.

The ordered $L1_2$γ' phase of Co is denser than an unordered Co matrix such that the precipitation of the γ' phase increases the density of the alloy whilst the high temperature strength and temperature capability is improved. The density of the alloy has an engine weight penalty that offsets the improved temperature capability of the alloy.

By contrast the ordered $L1_2$γ' phase of nickel is less dense than the matrix Ni, which permits a virtuous circle in Ni based superalloys such that an increase in γ' content results in a reduction in alloy density whilst simultaneously increasing the temperature and capability and strength of the alloy.

Increasing alloy temperature capability by increasing the gamma prime (γ') content can affect the alloy's resistance to oxidation because chromium, which has been found to advantageously improve an alloy's oxidation and hot corrosion resistance, has extremely limited solubility in the gamma prime phase.

Where Ni and Co are present in atomic percent (at %) or wt % ratios of around 1:1.3, a density increase from the formation of the $L1_2$γ' phase of Co is not only offset by a density reduction of the ordered $L1_2$γ' phase of Ni particularly where the γ' has a continuous phase field between $Ni_3Al$,X (where X=Ti, Ta, Nb) and $Co_3Al$,Z (where Z=W, Ta, Nb) but also allows more chromium to enter the gamma prime phase. This means that higher alloy chromium content can be tolerated before reaching such high levels in the matrix gamma (γ) phase that undesirable phases such as sigma (σ) are formed. In addition the higher Co content permits the γ' phase to contain relatively more (W, Ta) than where the Ni:Co ratio is closer to parity and therefore to have a lower effective diffusivity in the γ' phase, giving the alloy slower coarsening and creep kinetics.

Table 1 details the weight percent of a number of exemplary alloys listed as Alloy A to Alloy G. All of the alloys contain Co, Ni, Cr, W, Al, Ta, C, B and Zr and selected alloys have one or more of Ti, Fe, Si, Mn, Mo and Nb. The density in g/cm$^3$ and an estimate of γ' volume fraction of each of the alloys is detailed in Table 2.

The Co—Al—Z alloy has a face centred cubic (FCC) structure in the γ matrix and $L1_2$γ' phase whilst Cr has a body centred cubic (BCC) structure. An excessive amount of Cr in the Co—Al—Z base alloy can destabilise the γ/γ' microstructure. Advantageously, Ni substitutions for Co have been found to stabilise the γ' phase and increase the size of the phase field and improve the stability of the alloy. The Face Centred Cubic (FCC) γ cobalt alloys can tolerate a higher Cr content than FCC γ nickel to also permit enhanced oxidation resistance.

Aluminium solubility in the γ matrix increases with the Co:Ni ratio and which offsets, from a density standpoint, the increased tungsten (W) content required in the γ' phase as the Co:Ni ratio rises.

To provide sufficient Al in the alloy to permit formation of the $Ni_3Al\gamma'$ phase the quantity of Al in the alloy is greater than 4.0 wt % but preferably less than 6.0 wt %. Aluminium is also soluble in the γ matrix of the $Co_3$(Al, W) matrix and lower levels do not leave sufficient to form the γ' phase with the Ni.

A proportion of W added to the alloy partitions to the γ phase and is an effective source of solid strengthening of the γ matrix. Preferably the level of W in the alloy is between 6 and 15 wt %, and more preferably below 10 wt %.

Significant Ta, Ti and Nb contents are possible in the alloys which can partially substitute for W in the $Co_3$(Al, W) matrix. The Ta increases the γ' solvus temperature when replacing W in the $Co_3$(Al, W) matrix. As the temperature capability of the alloy is partially determined by the solvus temperature, advantageously keeping the solvus temperature above a threshold increases the number of high temperature applications for which the alloy may be used. It is desirable for the combined tungsten, tantalum and niobium content to be around 4.0 at % of the alloy.

Substituting W for Ta and Nb can result in further reductions in the alloy density. Tungsten also has a tendency to form acidic oxides that are detrimental to hot corrosion resistance. Reducing the amount of W in the alloy to below 10 wt % is understood to improve resistance to type II hot corrosion damage. Tungsten is also cheaper than Ta so reducing the amount of Ta reduces the cost of the alloy.

Tantalum is preferably used within the range 2.9 to 5.0 wt % but more preferably within the range 2.9 to 3.3 wt %.

The levels of Ti are kept below 2 wt % due to its propensity to diffuse to exposed surfaces to form rutile ($TiO_2$), which is a porous and non-protective scale. Higher levels of Ti can reduce the alloys resistance to oxidation damage. The addition of Ti produces unstable primary MC carbide, which will transform to Cr containing $M_{23}C_6$ carbides that precipitate on grain boundaries on exposure to temperatures between 800 and 900° C. It is understood that a very limited precipitation of small $M_{23}C_6$ carbide particles is beneficial for minimising grain boundary sliding during periods of sustained loading at elevated temperature.

The amount of Nb is limited to below 2.5 wt % to avoid formation of delta (δ) phase.

The low γ' solvus temperatures of the $Co_3$(Al,Z) γ' strengthened alloys and the low rate of diffusion of W in Co enables precipitation of small γ' particles that are typically less than 50 nm in size during quenching from a temperature above the γ' solvus temperature.

To investigate the phase stability of these alloys, 50 g finger-shaped polycrystalline ingots were produced by vacuum arc melting under a back-filled argon atmosphere. Cobalt-10 W (at %) and Co-20 W (at %) master alloys were used along with high-purity elemental pellets of 99.99% Cr; 99.97% Ni; 99.9% Al, Ti, Ta and Si; 99.8% Co; and 99.0% Fe. The as-cast ingots were then vacuum solution heat-treated at 1300° C. for 24 hours. Subsequently, the ingots were encapsulated in rectilinear mild steel cans with Ti powder packing material and hot rolled above the γ' solvus temperature at 1150° C. to a sample thickness of 3-6 mm. A NETZSCH Jupiter differential scanning calorimeter (DSC) was then employed to determine the solvus temperature at a 10° C./minute scan rate under argon atmosphere. The alloys were aged at 80-100° C. below the γ' solvus temperature. For all the ageing heat treatments, the alloys were sealed in quartz tubes which were back-filled with argon after evacuation. On completion of the heat treatment, the alloys were allowed to cool in the furnace.

Alloy compositions were measured using Inductively Coupled Plasma-Optical Emission Spectroscopy (ICP-OES) and density measurements were performed according to ASTM B311-08 at room temperature.

The microstructure of the alloy was examined using the LE01525 field emission gun scanning electron microscope (FEG-SEM) in the secondary electron imaging mode. Secondary phase compositions were measured using energy dispersive X-ray spectroscopy (EDX). The samples were ground, polished and electro-etched in a solution of 2.5% phosphoric acid in methanol at 2.5 V at room temperature for few seconds.

Since the volume fraction of the γ' is high, the spacing between the small particles is even smaller, which ensures that any dislocations tend to cut or shear through the particles rather than pass around them. The difficult passage of dislocations through the particles gives rise to a very high yield stress value for the alloys.

The refractory content of the γ' phase minimises the coarsening of the precipitate particles during ageing heat treatment and high temperature exposure of the alloy in use due, in part, to the low rates of diffusion of the refractory elements within the alloy. Accordingly, the alloys exhibit excellent resistance to creep strain accumulation and resistance to fatigue crack nucleation. A high resistance to dwell crack growth is required for safety critical applications such as use in a disc rotor.

The alloys A to G are suitable for use at temperatures of 800° C. At these temperatures a dense and protective chromia scale provides resistance to oxidation and hot corrosion damage in the cobalt-nickel base alloys. The level of Cr in the alloys is therefore preferably above 10 wt % and between 10 and 16 wt % a value of between 13 and 14 wt % has been found to offer good qualities in the alloy. As the Cr content is increased the γ/γ' microstructure becomes less stable. At a Cr level of around 10 wt % to the base alloy the γ' becomes rounded with an average γ' of approximately 80 nm. The γ/γ' microstructure is still observed at 13 at % Cr, but increasing the level above 16 wt % results in the precipitation of undesirable secondary phases (CoAl and $Co_3W$), a discontinuous precipitation and an absence of cuboidal γ'. Excessive levels of Cr and too low levels of Ni result in alloys where the γ' field shrinks or even disappears, resulting in the precipitation of the B2 (Co, Ni)Al and/or $DO_{19}Co_3W$ phases. These intermetallics result in alloys that are brittle and show poor oxidation resistance, and therefore the levels of Cr and Ni need to be carefully balanced to provide oxidation resistance and microstructural stability.

Limited amounts of Si and Mn can also be added to the alloy to produce thin films of silica and/or $MnCr_2O_4$ spinel beneath the chromia scale. These films improve the barrier to the diffusion of oxygen and thus the resistance to environmental damage. In the γ' phase, the Si replaces Al whilst in the γ it substitutes for Cr. Values of Si below 1.0 wt % are required as at temperatures above 600° C. it has a tendency to partition to the γ and can promote the formation of sigma (σ) phase at grain boundaries during prolonged exposure at temperatures above 750° C. This topologically close packed phase is undesirable as it removes Cr from the γ matrix, thereby reducing environmental resistance, and reduces grain boundary strength. Where Mn is used, it replaces Ni and/or Co but partitions to the γ phase at temperatures above 500° C. and its presence in an amount of 0.6 wt % or less is preferred. Manganese, at levels of 0.2-0.6 wt. %, has been previously shown (U.S. Pat. No. 4,569,824) to improve corrosion resistance at temperatures between 650-760° C. and creep properties of polycrystalline Ni alloys, which contain 12-20 wt. % Cr.

Iron may be added to the alloy to reduce the cost. The presence of Fe has the beneficial effect of increasing the hardness of the alloy but at values above 20 wt % does have a tendency to destabilise the microstructure. Where Fe is present, it is preferred that it is provided in an amount that is less than 10 wt % and more preferably less than 8 wt %.

It is desirable to add molybdenum (Mo) as it partitions to the gamma phase and provides solid solution strengthening to improve gamma strength. It also readily forms boride particles to pin grain boundaries and dislocations and therefore assist the resistance to high temperature deformation. However, excessive Mo can lead to the formation of the σ phase in the alloy. Molybdenum also has a tendency to form acidic oxides in the alloy that are detrimental to hot corrosion resistance. It is preferred that Mo levels are below 4 wt % to achieve an acceptable balance of properties, avoiding undesirable phases.

A preferred method of manufacture for producing the alloys is to use powder metallurgy. Small powder particles, preferably less than 53 μm in size from inert gas atomisation, are consolidated in a steel container using hot isostatic pressing (HIP) at temperatures that are preferably above the γ' solvus temperature of the alloy. For some components, it is possible to directly form the component from the HIP process. For other components, such as disc rotors, it is beneficial to take the HIP compacted article and subject it to extrusion to produce appropriately sized billets. Material from these billets can then be isothermally forged at low strain rates at temperatures that are preferably above the γ' solvus temperature of the alloy.

The presence of Zr, B and C is beneficial in polycrystalline Ni or Co alloys as they are known to improve grain boundary strength. The use of powder metallurgy limits the size of carbide and boride particles, allows higher B levels without grain boundary liquation and enables the majority of carbides to reside at intragranular locations.

Carbide, oxide and oxy-carbide particles are present at the surfaces of powder particles after HIP. These particles form networks known as prior particle boundaries (PPBs). They remain after extrusion but are no longer in connected networks. However, they are able to provide a means to pin grain boundaries and control grain growth during forging above the γ' solvus temperature of the alloy. Forging strains and strain rates are selected to achieve and an average grain size of 23 to 64 μm (ASTM 8 to 5) with isolated grains As Large As (ALA) 360 μm (ASTM 0) following forging or after subsequent solution heat treatment above the γ' solvus temperature.

The advantage of powder metallurgy is that it gives rise to a coarse grain microstructure that improves damage tolerance, particularly under conditions in which oxidation and time dependent deformation influence fatigue crack growth resistance. Specific levels of B, Zr, Hf and, to a lesser extent, C have been added to optimise grain boundary strength and therefore the resistance to high temperature deformation.

Zirconium and hafnium may be added to the alloys in concentrations up to 0.1 wt %. The addition of Zr and Hf can improve the dwell crack growth resistance of the alloy as it has an affinity for sulphur (S) and oxygen ($O_2$) and scavenges these elements at grain boundaries. In combination with Co, they also stabilise primary MC carbide, limiting the formation of Cr and Mo rich grain boundary $M_{23}C_6$ carbides. However, $HfO_2$ particles can be produced during melting, which need to be managed as these can limit the resistance of the alloy to fatigue crack nucleation. The use of Hf therefore needs to be balanced against the likely benefits for a particular alloy for a particular application.

It is preferred that the alloys are forged above the γ' solvus temperature to minimise the flow stress for superplastic deformation. The required grain size can therefore be achieved without a super-solvus solution heat treatment after forging. As such, forgings can be furnace cooled after forging and then given a precipitation ageing heat treatment at temperatures of 80-100 below the γ' solvus temperature for 4 to 24 hours. Furnace cooling after forging is beneficial as it produces very fine serrated grain boundaries around the γ' particles. Such serrated grain boundaries are understood to improve the dwell crack growth resistance of the alloy as they inhibit grain boundary sliding, a form of creep damage.

The compositional ranges disclosed herein are inclusive and combinable, are inclusive of the endpoints and all intermediate values of the ranges). The modifier "about" used in connection with a quantity is inclusive of the stated value, and has the meaning dictated by context, (e.g., includes the degree of error associated with measurement of the particular quantity).

Weight percent levels are provided on the basis of the entire composition, unless otherwise specified. The terms "first," and "second," do not denote any order, quantity, or importance, but rather are used to distinguish one element from another. The terms "a" and "an" do not denote a limitation of quantity, but rather denote the presence of at least one of the referenced items. The suffix "s" is intended to include both the singular and the plural of the term that it modifies, thereby including one or more of that term (e.g. "the refractory element(s)" may include one or more refractory elements). Reference throughout the specification to "one example" or "an example", etc., means that a particular element described in connection with the example is included in at least one example described herein, and may or may not be present in other examples. In addition, it is to be understood that the described inventive features may be combined in any suitable manner in the various examples.

TABLE 1

| | Weight % | | | | | | | | | | | | | | |
|---|---|---|---|---|---|---|---|---|---|---|---|---|---|---|---|
| Alloy | Co | Ni | Cr | W | Fe | Mn | Mo | Al | Ta | Nb | Ti | Si | C | B | Zr |
| A | 39.59 | 30.33 | 13.12 | 9.27 | 0.00 | 0.00 | 0.00 | 4.54 | 3.04 | 0.00 | 0.00 | 0.00 | 0.030 | 0.025 | 0.055 |
| B | 39.45 | 30.22 | 13.07 | 9.24 | 0.00 | 0.00 | 0.00 | 4.07 | 3.03 | 0.00 | 0.80 | 0.00 | 0.030 | 0.025 | 0.055 |
| C | 40.20 | 30.80 | 13.32 | 7.06 | 0.00 | 0.00 | 0.00 | 4.61 | 2.32 | 1.59 | 0.00 | 0.00 | 0.030 | 0.025 | 0.055 |
| D | 37.32 | 28.59 | 14.20 | 7.06 | 0.00 | 0.00 | 3.28 | 5.53 | 2.32 | 1.59 | 0.00 | 0.00 | 0.015 | 0.050 | 0.055 |
| E | 36.89 | 28.26 | 14.29 | 7.11 | 0.00 | 0.00 | 3.30 | 5.66 | 2.33 | 1.60 | 0.00 | 0.55 | 0.015 | 0.050 | 0.055 |

TABLE 1-continued

| | Weight % | | | | | | | | | | | | | | |
|---|---|---|---|---|---|---|---|---|---|---|---|---|---|---|---|
| Alloy | Co | Ni | Cr | W | Fe | Mn | Mo | Al | Ta | Nb | Ti | Si | C | B | Zr |
| F | 36.57 | 28.02 | 14.29 | 7.11 | 0.00 | 0.55 | 3.30 | 5.56 | 2.33 | 1.60 | 0.00 | 0.55 | 0.015 | 0.050 | 0.055 |
| G | 35.25 | 27.01 | 13.17 | 9.32 | 7.54 | 0.00 | 0.00 | 4.55 | 3.05 | 0.00 | 0.00 | 0.00 | 0.030 | 0.025 | 0.055 |

TABLE 2

| Alloy | Co:Ni ratio | W + Ta + Nb (at %) | Al + Ti (at %) | Estimated γ' vol % | Mo + W (at %) | Density ($g \cdot cm^{-3}$) |
|---|---|---|---|---|---|---|
| A | 1.3:1 | 4 | 10 | 56 | 3 | 8.54 |
| B | 1.3:1 | 4 | 10 | 56 | 3 | 8.57 |
| C | 1.3:1 | 4 | 10 | 56 | 2.25 | 8.41 |
| D | 1.3:1 | 4 | 12 | 64 | 4.25 | 8.43 |
| E | 1.3:1 | 4 | 12 | 64 | 4.25 | 8.38 |
| F | 1.3:1 | 4 | 12 | 64 | 4.25 | 8.37 |
| G | 1.3:1 | 4 | 10 | 56 | 3 | 8.51 |

The estimated volume fraction of γ' is at ambient temperature.

The invention claimed is:

1. A cobalt-nickel alloy composition comprising by weight (wt %):

31 to 42 percent cobalt (Co);

10 to 16 percent chromium (Cr);

4 to 6 percent aluminium (Al);

6 to 15 percent tungsten (W);

a balance of 26 to 31 percent nickel (Ni) and incidental impurities;

the Co and Ni being present in an atomic ratio between 1.2:1 and 1.4:1, wherein particles of the alloy have an average grain size of 23 to 64 μm.

2. An alloy according to claim 1, wherein the alloy further comprises at least one of niobium (Nb) or tantalum (Ta) wherein the combined total of niobium, tantalum and tungsten is 10 to 15 weight percent.

3. An alloy according to claim 2, comprising by weight (wt %):

about 13 to 16 percent chromium (Cr).

4. An alloy according to claim 3, wherein the Co and Ni are present in the atomic ratio of 1.3:1.

5. An alloy according to claim 3, wherein the alloy comprises iron (Fe) in an amount up to 8 wt % of the alloy.

6. An alloy according to claim 1, comprising by weight (wt %):

13 to 16 percent chromium (Cr).

7. An alloy according to claim 6, wherein the Co and Ni are present in the atomic ratio of 1.3:1.

8. An alloy according to claim 1, wherein the Co and Ni are present in the atomic ratio of 1.3:1.

9. An alloy according to claim 1 wherein the alloy comprises about 7.0 to 9.3 wt % W.

10. An alloy according to claim 1 wherein the alloy comprises about 13.0 to 14.3 wt % Cr.

11. An alloy according to claim 1, wherein the alloy comprises iron (Fe) in an amount up to 8 wt % of the alloy.

12. An alloy according to claim 1, wherein the alloy comprises manganese (Mn) in an amount up to 0.6 wt % of the alloy.

13. An alloy according to claim 1, wherein the alloy comprises tantalum (Ta) in an amount up to 5.0 wt %.

14. An alloy according to claim 1, wherein the alloy comprises Nb in an amount up to 2.5 wt % of the alloy.

15. An alloy according to claim 1, wherein the alloy comprises Ti in an amount up to 2.0 wt % of the alloy.

16. An alloy according to claim 1, wherein the alloy comprises silicon (Si) in an amount up to 1.0 wt % of the alloy.

17. An alloy according to claim 1, wherein the alloy comprises carbon (C) in an amount up to 0.05 wt % of the alloy.

18. An alloy according to claim 1, wherein the alloy comprises boron (B) in an amount up to 0.05 wt % of the alloy.

19. An alloy according to claim 1, wherein the alloy comprises zirconium (Zr) in an amount 0.1 wt % of the alloy.

20. An alloy according to claim 1, wherein the alloy comprises hafnium (Hf) in an amount up to 0.1 wt % of the alloy.

* * * * *